US008677666B2

(12) United States Patent
Pichler

(10) Patent No.: US 8,677,666 B2
(45) Date of Patent: Mar. 25, 2014

(54) DROP-SAFETY MECHANISM FOR A FIREARM

(75) Inventor: Harald Pichler, Gaflenz (AT)

(73) Assignee: Steyr Mannlicher GmbH, Kleinraming (AT)

( * ) Notice: Subject to any disclaimer, the term of this patent is extended or adjusted under 35 U.S.C. 154(b) by 90 days.

(21) Appl. No.: 13/378,900

(22) PCT Filed: May 6, 2010

(86) PCT No.: PCT/AT2010/000151

§ 371 (c)(1),
(2), (4) Date: Dec. 16, 2011

(87) PCT Pub. No.: WO2011/000004

PCT Pub. Date: Jan. 6, 2011

(65) Prior Publication Data

US 2012/0090213 A1 Apr. 19, 2012

(30) Foreign Application Priority Data

Jun. 30, 2009 (AT) ..... A1019/2009
Jun. 30, 2009 (AT) ..... A1020/2009
Jul. 21, 2009 (AT) ..... A1140/2009

(51) Int. Cl.
*F41A 17/00* (2006.01)

(52) U.S. Cl.
USPC ..... 42/70.06; 42/70.01; 42/70.05; 42/70.09

(58) Field of Classification Search
USPC ..... 42/70.01, 70.06, 70.05, 70.09
See application file for complete search history.

(56) References Cited

U.S. PATENT DOCUMENTS

| | | | | |
|---|---|---|---|---|
| 3,255,545 | A | 6/1966 | Chambers et al. | |
| 3,707,796 | A | 1/1973 | Bielfeldt | |
| 4,151,670 | A * | 5/1979 | Rath | 42/70.06 |
| 4,475,437 | A * | 10/1984 | Sullivan | 89/148 |
| 5,402,593 | A * | 4/1995 | Lenkarski et al. | 42/70.06 |
| 5,697,178 | A * | 12/1997 | Haskell | 42/70.04 |
| 5,881,485 | A * | 3/1999 | Milazzo | 42/70.08 |
| 2009/0044438 | A1 * | 2/2009 | Yollu | 42/70.06 |

FOREIGN PATENT DOCUMENTS

| | | |
|---|---|---|
| DE | 2059396 A1 | 6/1972 |
| DE | 29708316 U1 | 9/1997 |
| EP | 0166714 A1 | 1/1986 |

OTHER PUBLICATIONS

International Searching Authority Written Opinion for PCT/AT2010/000151 dated Apr. 30, 2010.
International Search Report for PCT/AT2010/000151 dated Aug. 3, 2010.
Austrian Official Action dated Mar. 17, 2010.
International Preliminary Report on Patentability dated Jan. 17, 2012.

* cited by examiner

*Primary Examiner* — Samir Abdosh
(74) *Attorney, Agent, or Firm* — Hoffmann & Baron, LLP

(57) ABSTRACT

The invention relates to a drop-safety mechanism for a firearm having a pivot-mounted, trigger, said trigger being designed as an arm of a double lever, the other arm of which supports a counterweight that can be displaced between a rest position and a functional position. The counterweight is resiliently pre-tensioned in the rest position and strikes on a part of the firearm in the functional position to block the trigger from unintended firing.

9 Claims, 2 Drawing Sheets

DROP-SAFETY MECHANISM FOR A FIREARM

CROSS-REFERENCE TO RELATED APPLICATIONS

This application is a National Phase application of International Application No. PCT/AT2010/000151 filed May 6, 2010 which claims priority to Austrian Patent Application Nos. A 1019/2009 filed Jun. 30, 2009; A 1020/2009 filed Jun. 30, 2009; and A 1140/2009 filed Jul. 21, 2009.

BACKGROUND

The present invention relates to a drop-safety mechanism for a firearm with a pivot-mounted trigger.

Drop-safety mechanisms are used to prevent discharge in case of a collision impact on the weapon, e.g., if it lands on the ground with its stock or receives an impact on the stock. Without a drop-safety mechanism, the trigger could move backward due to its moment of inertia and fire a shot. Therefore movable masses are provided for the weapon that move in the same manner as the trigger in such a case and insert themselves in front of a catch in order to block it.

In known drop-safety mechanisms, the movable mass is supported on the housing, which requires a relatively large amount of space. The invention has the objective of creating a more compact solution.

SUMMARY

This objective is achieved according to the invention in that the trigger is constructed as part of a two-armed lever, whose other arm supports a counterweight, movable between a rest position and a functional position, that is pretensioned into the rest position and strikes against a part of the firearm in the functional position in order to block the trigger.

In this manner, the drop-safety mechanism is supported directly on the trigger, which results in an exceedingly compact, free-moving and malfunction-resistant mechanism.

The counterweight is preferably pivot-mounted on the aforementioned arm, a compression spring acting between a shoulder of the counterweight and a shoulder of the arm, which results in a particularly safe operation.

A preferred embodiment of the invention is distinguished in that the aforementioned part of the firearm, against which the counterweight strikes in the functional position, is a part of the hand-cocking mechanism of the firearm. Thereby the already existing part of the hand-cocking mechanism can serve as a stop, which further reduces the space requirement for the drop-safety mechanism.

BRIEF DESCRIPTION OF THE DRAWINGS

The invention will be explained in detail below with reference to an exemplary embodiment illustrated in the attached drawings. In the drawings.

DETAILED DESCRIPTION

Figure 1:
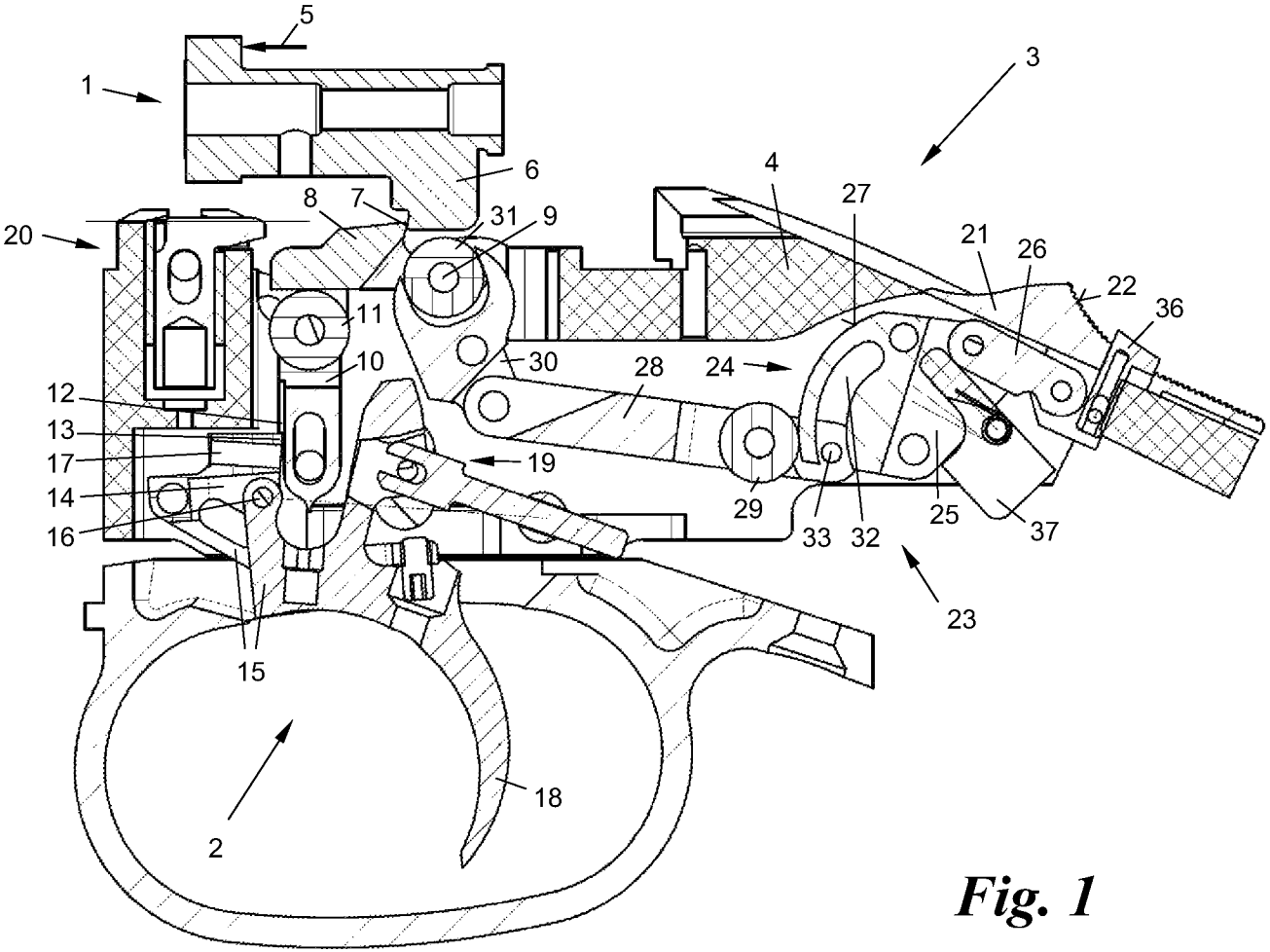
FIG. 1 shows the hand-cocking and trigger mechanism of a firearm with a drop-safety mechanism according to the invention in cross section.

FIG. 1 shows the rear part of a firing pin 1, a trigger mechanism 2, a cocking and uncocking mechanism 3 and (in part) a housing 4 of a firearm (not shown in further detail). The firing pin 1 acts on a cartridge in the chamber of a rifle barrel and is guided for this purpose in a rotary piston, for example, which parts are known to those in the art and are therefore not shown in detail here.

The firing pin 1 is subjected to a force to the left in the drawing by a firing pin spring 5 (indicated schematically) and is engaged with a firing pin tab 6 at point 7 on a catch 8. The catch 8 is seated movably, in both the longitudinal and the transverse directions of the firing pin, by a bearing journal 9 in elongated holes of the housing 4. Thus the catch 8 can first be released from the firing pin 1 by means of the trigger mechanism 2 to fire a shot, so that the firing pin moves to the left by the force of the firing pin spring 5 to collide with the cartridge; second, the catch 8 can thus also be moved or displaced in the longitudinal direction between two positions, specifically, an unsecured or cocked position (FIGS. 2 and 3), in which the catch holds the firing pin 1 cocked against the force of the firing pin spring 5, and an uncocked safety position (FIG. 1) in which the catch 8 is displaced to the left in the drawing, in order to relieve the tension of the firing pin spring 5.

To absorb the above-mentioned displacement motion of the catch 8, the trigger mechanism 2 comprises an intermediate element in the form of a catch rod 10 that is linearly guided in the housing 4 approximately vertically and supports a ball bearing-seated roller 11 at its upper end, on which the catch 8 can slide back and forth. The catch rod 10 in turn is engaged at a shoulder 12 on a click-stop edge 13 formed on a shoulder 14 of the trigger 15. The trigger 15 is pivotably seated at 16 on the housing 4 and, when actuated, moves the click-stop edge 13 away from the catch rod 10, so that the latter is moved downward and releases the catch 8 from the firing pin 1, whereby the shot is fired. The extent of the engagement overlap between the shoulder 12 of the catch rod 10 and the click-stop edge 13 of the trigger 15 can be adjusted by means of an adjusting screw 17.

The trigger 15 with its click-stop edge 13 can be integrally formed or—as shown—formed as two parts adjustable relative to one another, such as a first part comprising the actual trigger blade 18 and a second part comprising the shoulder 14 with the click-stop edge 13.

The trigger 18 is equipped with a drop-safety mechanism 19, which will be described in detail below. The trigger 15 can further be equipped with a bolt catch 20 for triggering a rotary piston action, as known to those in the art.

Figure 2:
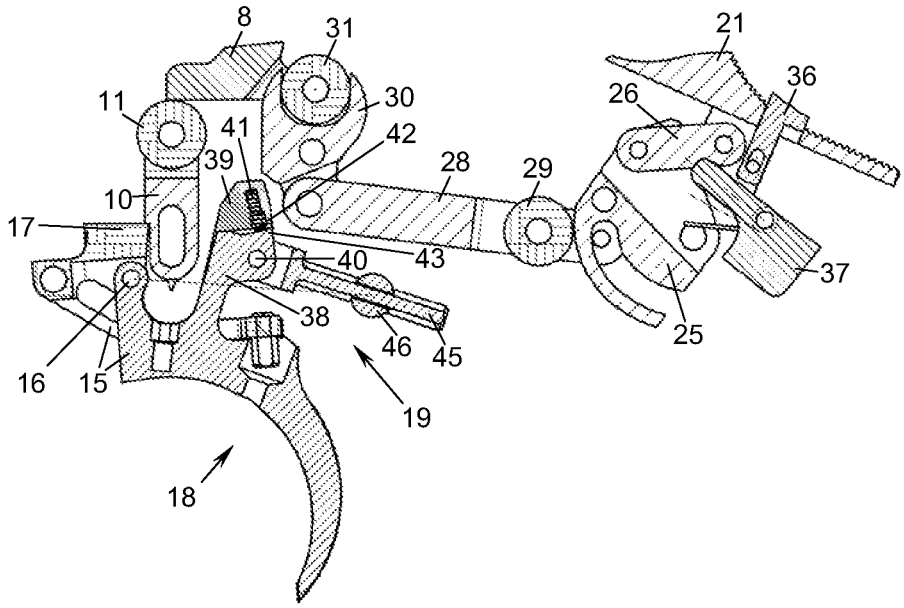
FIGS. 2 and 3 show the drop-safety mechanism of FIG. 1 in detail in the rest position (FIG. 2) and the functional position (FIG. 3).

The cocking and uncocking mechanism 3 comprises an actuator element 21 in the form of a cocking slide 21 slidably seated on the outside of the housing 4 with a thumb-press surface 22, which acts via a linkage 23 on the catch 8 in order to move it back and forth in the longitudinal direction of the firing pin between its two positions (FIGS. 1, 2/3). The linkage 23 contains a motion link 24, via which the force/distance transmission ratio between the actuator element 21 and catch 8 can be adjusted.

The motion link 24 comprises a pivoting crank 25 that can be pivoted by the cocking slide 21 via a connecting rod 26 and bears a control cam 27 on its outer periphery. A sensing linkage 28 with a ball bearing-seated cam follower 29 rolls over the control cam 27 and translates the shape of the control cam 27 into a movement of the catch 8 via a housing-seated two-armed lever 30 that engages with a pin 31 of the catch 8.

The pivoting crank 25 is also equipped with an auxiliary linkage guide 32 in the form of a groove guide that is located behind the control cam 27 and with which the sensing linkage 28 engages by means of a retaining pin 33 projecting past the cam follower 29. Thereby a forced contact of the cam follower 29 on the control cam 27 is assured in every operating state.

When the cocking slide 21 is moved from right to left, the pivoting crank 25 swings downward, the sensing link 28 slides to the left on the control cam 27 and the catch 8 is moved to the right by the lever 29 against the force of the firing pin spring 5. With the aid of a push button 36 on the cocking slide 21, a self-locking latch 37 for locking the connecting rod 26 in the cocked position C can again be disengaged.

Figure 3:
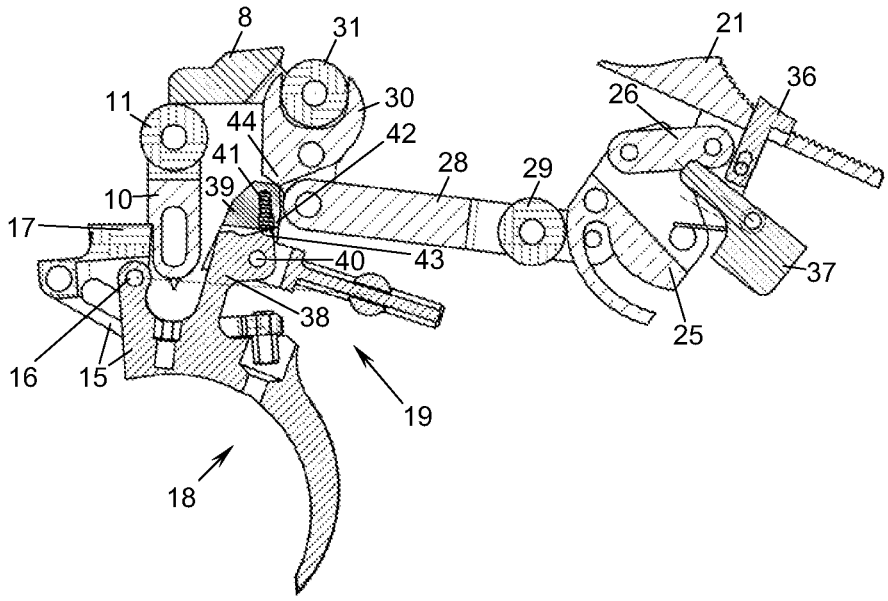

FIGS. 2 and 3 show the drop-safety mechanism 19 of the trigger 18 in detail. For this mechanism, the trigger blade 18 is constructed as one arm of a two-armed lever with respect to its articulation point 16, the other arm 38 of the lever supporting a counterweight 39. The counterweight 39 is pivot-mounted at 40 on the end of the arm 38, the pivot axis 40 running parallel to the pivot axis 16. The counterweight 39 is pretensioned into the rest position as shown in FIG. 2, in which it is moved forward in the shooting direction of the weapon, by means of a compression spring 41 that acts between a shoulder 42 of the counterweight and a shoulder 43 of the arm 38.

If a collision impact is exerted from the rear onto the firearm, the stock for example, or if the firearm falls and lands on its stock, the trigger 18 has the tendency to move to the right in the drawing, pivoting about the support point 16, due to its inertia. Due to the drop-safety mechanism 19, the counterweight 39 then moves—overcoming the bias tension of the spring 41 —in the same direction as the trigger 18 into the functional position shown in FIG. 3. In this position, the counterweight 39 strikes a part of the firearm, e.g., a catch or a protrusion in the housing of the firearm or—as in the example shown—against a projection 44 of the lever 30 or the end of the sensing linkage 28. Thereby a movement of the trigger 18 is blocked, and unintended firing due to a collision impact is prevented.

A bias spring (not shown) drawn onto a guide rod 45 and supported on a housing bearing 46 can also act on the lever arm 38 of the trigger 18 in order to realize a double-set trigger.

The invention is accordingly not limited to the illustrated embodiments, but instead comprises all variants and modifications that fall within the scope of the appended claims.

What is claimed is:

1. Drop-safety mechanism for a firearm with a pivot-mounted trigger, wherein the trigger is constructed as one arm of a two-armed lever with respect to the pivot, a counterweight movably mounted directly to the other arm of the lever the counterweight being movable between a rest position and a functional position, the counterweight being spring-biased toward the shooting direction of the firearm in the rest position and moves overcoming the bias of the spring to strike against a part of the firearm in the functional position to block movement of the trigger and prevent unintended firing.

2. Drop-safety mechanism according to claim 1, wherein the counterweight is pivot-mounted on the other arm of the lever, and wherein the counterweight is spring-biased via a compression spring which acts between a shoulder of the counterweight and a shoulder of the other arm.

3. Drop-safety mechanism according to claim 1, wherein the part of the firearm against which the counterweight strikes in the functional position is a part of a hand-cocking mechanism of the firearm, the hand cocking mechanism being movable between a cocked and an uncocked safety position.

4. Drop-safety mechanism according to claim 2, wherein the part of the firearm against which the counterweight strikes in the functional position is a part of the hand-cocking mechanism of the firearm, the hand cocking mechanism being movable between a cocked and an uncocked safety position.

5. Drop safety mechanism according to claim 3, wherein the hand-cocking mechanism comprises an actuator element which acts via a linkage on a catch to move the catch between a cocked and an uncocked safety position and the part which the counterweight strikes is the linkage.

6. Drop safety mechanism according to claim 4, wherein the hand-cocking mechanism comprises an actuator element which acts via a linkage on a catch to move the catch between a cocked and an uncocked safety position and the part which the counterweight strikes is the linkage.

7. Drop-safety mechanism for a firearm with a pivot-mounted trigger wherein the trigger comprises a first arm of a two-armed lever with respect to the pivot, a second arm of the lever supporting a pivot-mounted counterweight, the counterweight being movable between a rest position and a functional position, the counterweight being pretensioned into the rest position and moves to strike against a part of the firearm in the functional position to block movement of the trigger and prevent unintended firing, and wherein a compression spring acts between a shoulder of the counterweight and a shoulder of the second arm.

8. Drop-safety mechanism according to claim 7, wherein the part of the firearm against which the counterweight strikes in the functional position is a portion of a hand-cocking mechanism of the firearm, the hand cocking mechanism being movable between a cocked position and an uncocked safety position.

9. Drop safety mechanism according to claim 8, wherein the hand-cocking mechanism comprises an actuator which acts via a linkage on a catch to move the catch between a cocked and an uncocked safety position and the part which the counterweight strikes is the linkage.

* * * * *